US005419615A

United States Patent [19]

Dozsa-Farkas

[11] Patent Number: 5,419,615

[45] Date of Patent: May 30, 1995

[54] CHAIR WITH ADJUSTABLE SEAT AND BACKREST

[75] Inventor: Andras Dozsa-Farkas, München, Germany

[73] Assignee: Shin Yeh Enterprise Co., Ltd., Taiwan, Prov. of China

[21] Appl. No.: 147,136

[22] Filed: Nov. 3, 1993

[51] Int. Cl.[6] ..... A47C 7/02

[52] U.S. Cl. ..... 297/301; 297/304

[58] Field of Search ..... 297/285, 300–304, 297/328, 344.19, 344.21, 354.12

[56] References Cited

U.S. PATENT DOCUMENTS

| | | | |
|---|---|---|---|
| 4,703,974 | 11/1987 | Bräuning | 297/285 |
| 4,707,029 | 11/1987 | Korn | 297/301 X |
| 4,743,065 | 5/1988 | Meiller et al. | 297/301 X |
| 4,979,778 | 12/1990 | Shields | 297/301 |
| 5,069,496 | 12/1991 | Kunh et al. | 297/300 |

*Primary Examiner*—Kenneth J. Dorner
*Assistant Examiner*—Milton Nelson, Jr.
*Attorney, Agent, or Firm*—Ladas & Parry

[57] ABSTRACT

A chair includes a movable base, a first pneumatic cylinder, a support frame, a pivot frame, an elongated spring plate unit, and a second pneumatic cylinder. The first pneumatic cylinder is mounted uprightly on the movable base. The support frame has an upright sleeve which is sleeved rotatably on a top end of the first pneumatic cylinder, an arm plate which extends forwardly from a top end of the sleeve, and parallel front and rear shafts which are mounted transversely on the arm plate. The pivot frame has a front end that is mounted pivotally on the rear shaft and further has a seat and a backrest fixed thereon. The spring plate unit has a rear end portion which is mounted on the front end of the pivot frame and a front end portion which extends underneath and abuts with the front shaft. The second pneumatic cylinder is connected to a bottom end of the support frame and to a rear end of the pivot frame, and is operable so as to vary a length thereof in order to cause pivoting movement of the pivot frame and permit retaining of the seat and the backrest at desired inclined positions.

4 Claims, 6 Drawing Sheets

CHAIR WITH ADJUSTABLE SEAT AND BACKREST

BACKGROUND OF THE INVENTION

1. Field of the Invention

The invention relates to a chair construction, more particularly to a chair with a seat and backrest that can be retained adjustably at desired inclined positions.

2. Background of the Invention

Referring to FIGS. 1 and 2, a conventional chair is shown to comprise an upright pneumatic cylinder (C) mounted on a mobile base (B), a platform (D) mounted on a top end of the pneumatic cylinder (C), a seat support (E) mounted pivotally on the platform (D), a base plate (F) secured to the seat support (E), a seat (G) fixed to the base plate (F), and a backrest (H) mounted pivotally on a rear end of the base plate (F).

The top end of the pneumatic cylinder (C) is provided with a control knob (C1). A control lever (I) is mounted pivotally on the platform (D) and is operable so as to actuate the control knob (C1) in order to vary the length of the pneumatic cylinder (C) and adjust the height of the chair. A spring (J), a bolt (J1) and a control knob (J2) are disposed between the front ends of the platform (D) and the seat support (E) and permit limited pivoting movement of the seat support (E) and the seat (G) relative to the platform (D). A connecting seat (K1), a connecting plate (K2), a pair of springs (K3) and a mounting plate (K4) are provided between the base plate (F) and the backrest (H) and connect resiliently the same so as to permit inclination of the backrest (H) relative to the base plate (F) and the seat (G). A positioning tube (H1) is welded to a lower end of the backrest (H). A slide seat (L1) is provided on the base plate (F) and permits the passage of a slidable positioning rod (L) therethrough. When the positioning rod (L) extends into the positioning tube (Hi), the backrest (H) is prevented from inclining rearwardly relative to the base plate (F). Inclining movement of the backrest (H) is permitted only when the positioning rod (L) ceases to extend into the positioning tube (H1).

The drawbacks of the above described conventional chair are as follows:

1. The backrest (H) can be retained in an upright position only. Retaining of the backrest (H) at a desired inclined position is not permitted.
2. Since the conventional chair includes a large number of small components, the manufacture and assembly of the conventional chair is relatively complicated and entails a high manufacturing cost.
3. The restoration force for restoring the backrest (H) to the upright position cannot be adjusted to suit the user's requirements. For example, if the spring force of the springs (K3) is relatively strong, a small child would have difficulty in forcing the backrest (H) to the desired inclined position.
4. Although limited pivoting movement of the seat (G) is permitted, retaining of the seat (G) in an inclined position is also not permitted.

SUMMARY OF THE INVENTION

Therefore, the objective of the present invention is to provide a chair which can overcome the drawbacks that are commonly associated with the previously-described conventional chair construction.

Accordingly, a chair of the present invention comprises: a movable base; a first pneumatic cylinder mounted uprightly on the movable base; a support frame having an upright sleeve which is sleeved rotatably on a top end of the first pneumatic cylinder, an arm plate which extends forwardly from a top end of the sleeve, and parallel front and rear shafts which are mounted transversely on the arm plate, the rear shaft being interposed between the front shaft and the sleeve; a pivot frame having a front end that is mounted pivotally on the rear shaft and further having a seat and a backrest fixed thereon; an elongated spring plate unit having a rear end portion which is mounted on the front end of the pivot frame and a front end portion which extends underneath and abuts with the front shaft, the spring plate unit providing a restoration force to bias the pivot frame such that the backrest pivots forwardly to a normal upright position; and a second pneumatic cylinder connected to a bottom end of the support frame and to a rear end of the pivot frame, the second pneumatic cylinder being operable so as to vary a length thereof in order to cause pivoting movement of the pivot frame and permit retaining of the seat and the backrest at desired inclined positions.

BRIEF DESCRIPTION OF THE DRAWINGS

Other features and advantages of the present invention will become apparent in the following detailed description of the preferred embodiment, with reference to the accompanying drawings, of which.

DETAILED DESCRIPTION OF THE PREFERRED EMBODIMENT

Figure 1:
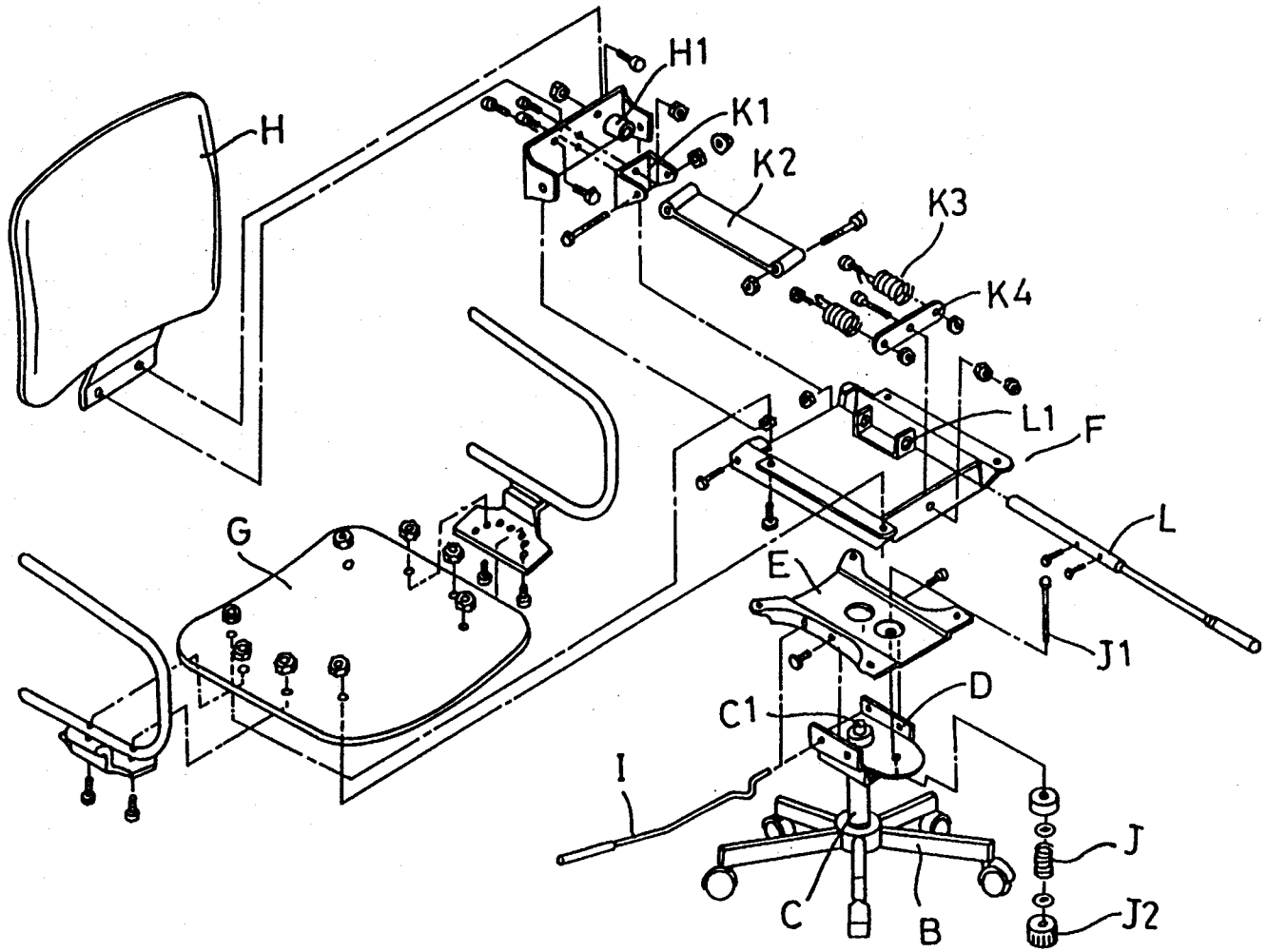
FIG. 1 (PRIOR ART)
FIG. 1 is an exploded view of a conventional chair.
Figure 2:
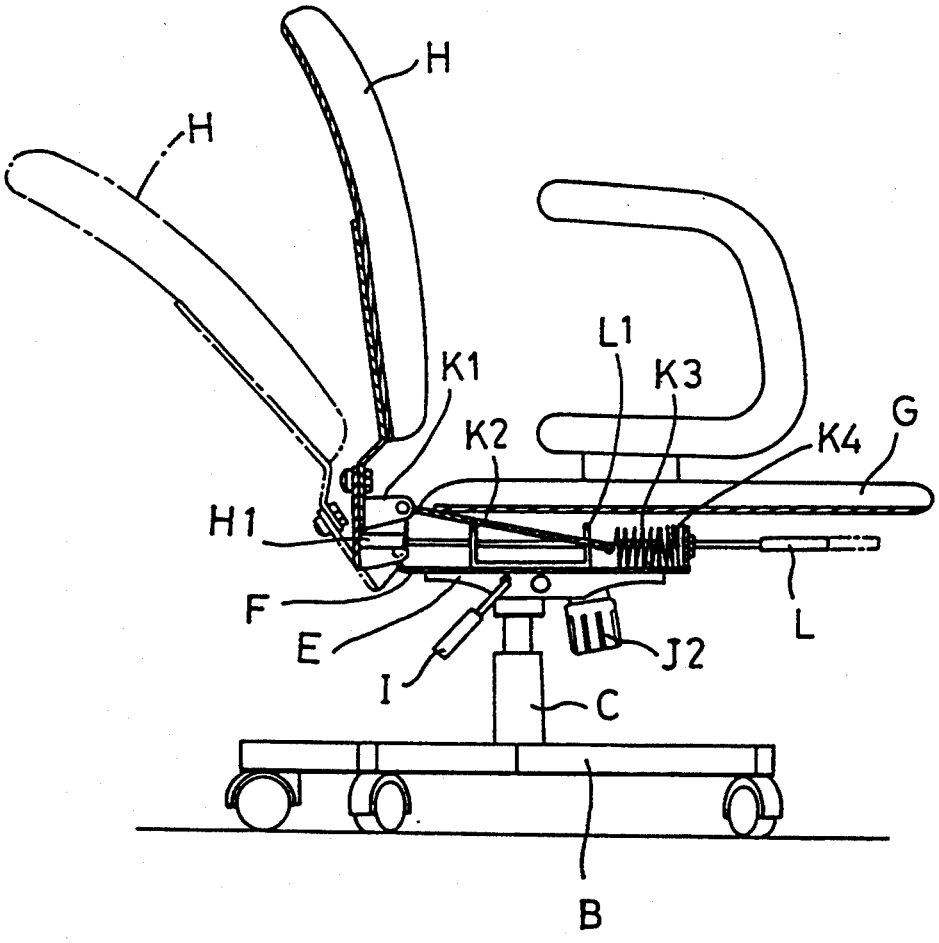
FIG. 2 (PRIOR ART)
FIG. 2 is a schematic side view illustrating how the inclination of a backrest of the conventional chair is adjusted.
Figure 3:
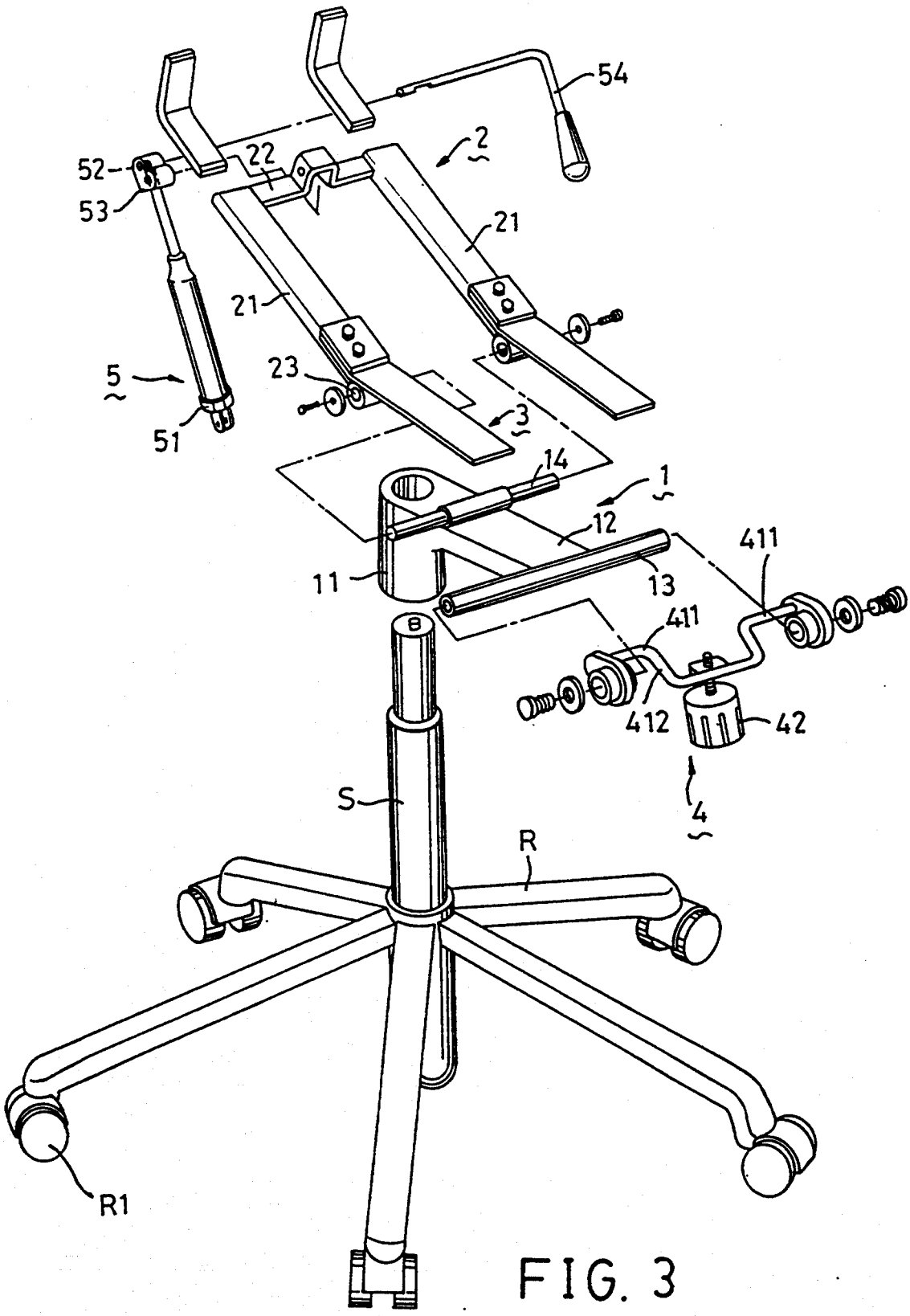
FIG. 3 is an exploded perspective view of a lower portion of the preferred embodiment of a chair with an adjustable seat and backrest according to the present invention.
Figure 4:
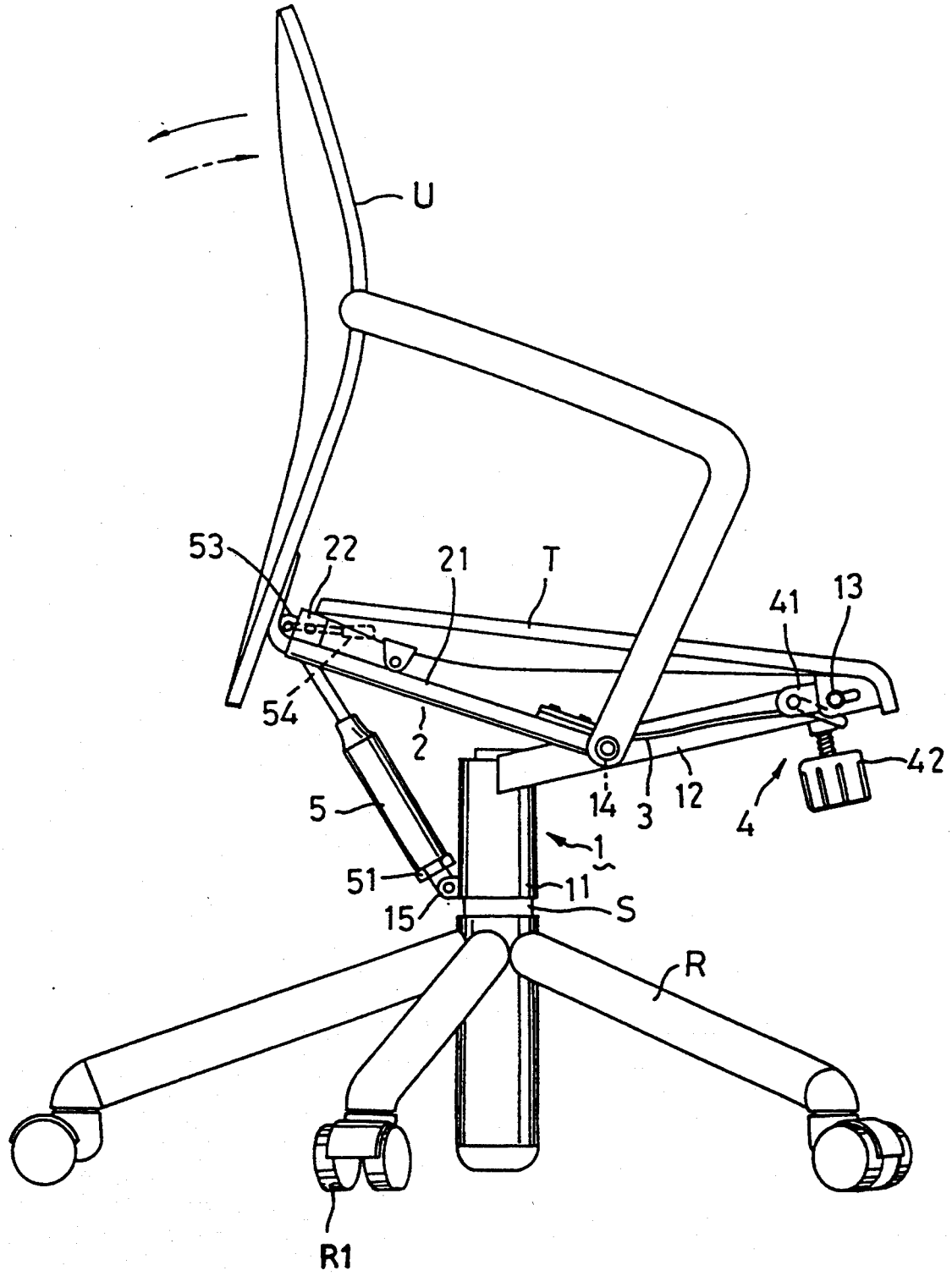
FIG. 4 is an assembled schematic side view of the preferred embodiment.
Figure 5:
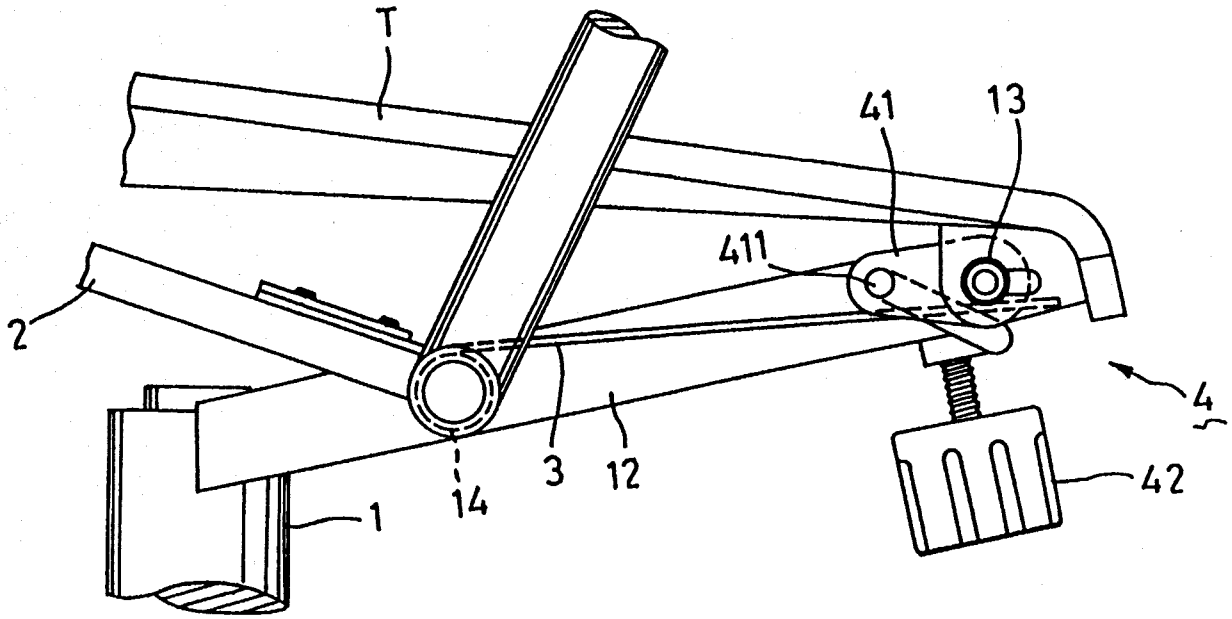
FIG. 5 illustrates the operation of a restoration force adjusting unit of the preferred embodiment.
Figure 6:
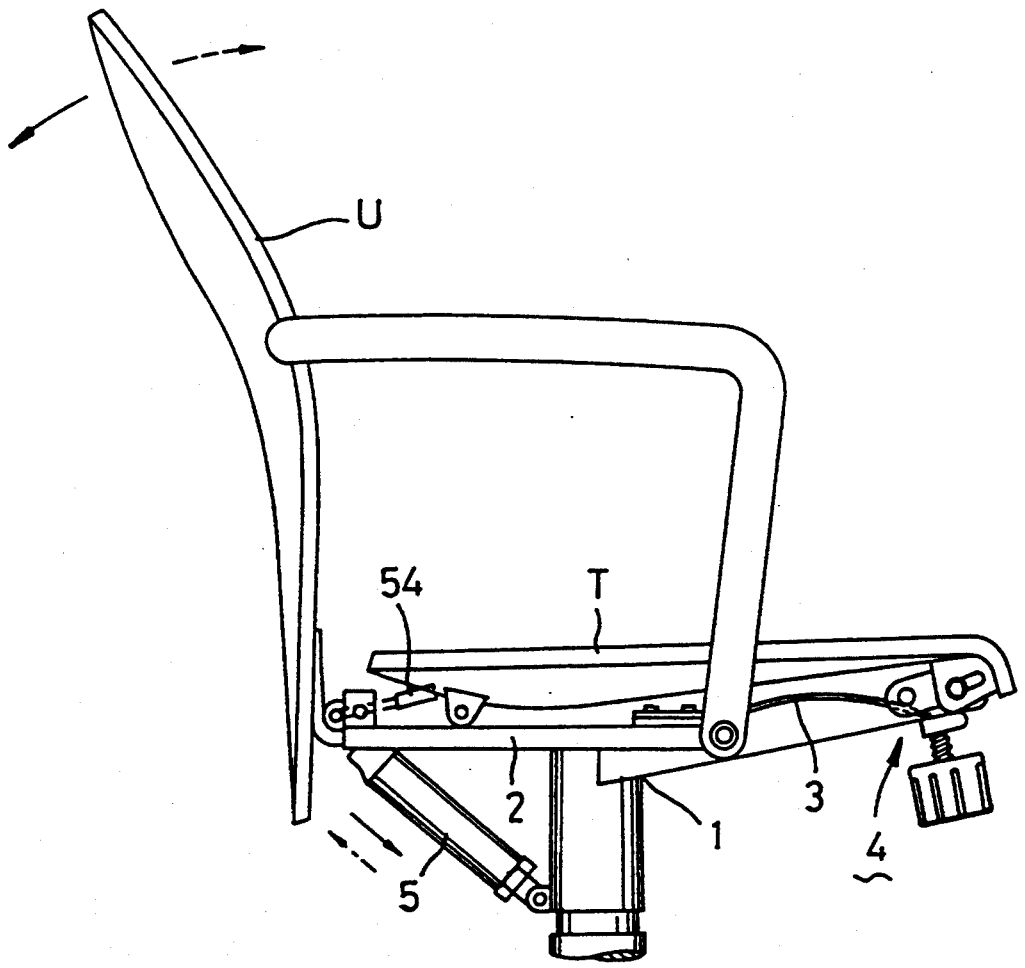
FIG. 6 illustrates how the inclinations of the seat and backrest of the preferred embodiment are adjusted.

Referring to FIGS. 3, 4 and 5, the preferred embodiment of a chair according to the present invention is shown to comprise a movable base (R) which is provided with a plurality of casters (R1) and which has an upright pneumatic cylinder (S) mounted thereon. The length of the pneumatic cylinder (S) can be varied to vary correspondingly the height of the chair. The chair of the present invention further comprises a support frame 1 provided on a top end of the pneumatic cylinder (S), a pivot frame 2 mounted pivotally on the support frame 1, an elongated spring plate unit 3 disposed between the support frame 1 and the pivot frame 2, a restoration force adjusting unit 4 mounted on the support frame 1 and associated operatively with the spring plate unit 3, an adjustable pneumatic cylinder 5 connected to the bottom end of the support frame 1 and to the rear end of the pivot frame 2, and a seat (T) and a backrest (U) fixed to the pivot frame 2. The inclination of the seat (T) and the backrest (U) can be adjusted and can be retained at desired angles.

The support frame 1 has an upright sleeve 11 which is sleeved rotatably on the top end of the pneumatic cylinder (S), and an arm plate 12 which extends forwardly from a top end of the sleeve 11. Parallel front and rear shafts 13, 14 are mounted transversely on the arm plate 12. The front shaft 13 is located adjacent to the distal end of the arm plate 12, while the rear shaft 14 is located between the front shaft 13 and the sleeve 11. The sleeve 11 has a bottom rear surface which is formed with a pivot ear 15.

The pivot frame 2 is a generally U-shaped frame with a pair of parallel bars 21 and a transverse bar 22 which extends between and interconnects rear ends of the parallel bars 21. Each of the parallel bars 21 has a front end which is provided with a transverse connecting tube 23 that is adapted to be sleeved on a respective end of the rear shaft 14, thereby mounting pivotally the pivot frame 2 on the rear shaft 14.

The spring plate unit 3 includes a pair of elongated spring plates, each of which having a rear end portion which is mounted on the front end of a respective one of the parallel bars 21 and a front end portion which extends underneath and abuts with the front shaft 13. The spring plate unit 3 provides the necessary restoration force to bias the pivot frame 2 such that the backset pivots forwardly to a normal upright position.

The restoration force adjusting unit 4 includes a bent shaft 41 and a rotary knob 42 mounted threadedly on the bent shaft 41. The bent shaft 41 has two aligned end sections 411 and a generally U-shaped intermediate section 412 which interconnects the aligned end sections 411. Each of the end sections 411 is mounted pivotally on a respective end of the front shaft 13. The junctions of the aligned end sections 411 and the intermediate section 412 rest on top of a respective one of the spring plates of the spring plate unit 3. The rotary knob 42 includes a threaded shank which is mounted threadedly on the intermediate section 412 of the bent shaft 41 and which has a distal end that abuts against a bottom face of the arm plate 12. When the rotary knob 42 is turned inwardly, the bent shaft 41 applies greater downward pressure on the spring plates of the spring plate unit 3 to vary the restoration force that is provided by the latter.

The pneumatic cylinder 5 has a cylinder end 51 which is mounted pivotally on the pivot ear 15 at the bottom rear surface of the support frame 1, and a distal piston shaft end which is provided with a control knob 52 and a pivot seat 53. The pivot seat 53 is mounted pivotally on the transverse bar 22 of the pivot frame 2. A control lever 54 extends transversely from the control knob 52 and is operable so as to actuate the control knob 52 in order to vary the length of the pneumatic cylinder 5 and cause pivoting movement of the pivot frame 2. Since the seat (T) and the backrest (U) are fixed to the pivot frame 2, pivoting movement of the latter results in adjustments in the inclinations of the seat (T) and the backrest (U). The control lever 54 is then operated so as to maintain the pneumatic cylinder 5 at a desired length, thereby maintaining the seat (T) and the backrest (U) at the desired inclined positions.

The operation of the preferred embodiment is described briefly as follows: When the spring plate unit 3 and the pneumatic cylinder 5 are in a normal state, the backrest (U) is biased to pivot forwardly to a normal upright position, as shown in FIG. 4. When a person reclines on the chair of the present invention, the backrest (U) pivots rearwardly against the actions of the pneumatic cylinder 5 and the spring plate unit 3. The control lever 54 is then operated so as to lock the pneumatic cylinder 5 at the desired length, thereby maintaining the seat (T) and the backrest (U) at the desired inclined positions. The restoration force adjusting unit 4 is operated so as to vary the restoration force that is provided by the spring plate unit 3 and is also operable so as to vary the force that is required to move the backrest (U) to the desired inclined position. Limited pivoting movement of the seat (T) is possible because it is disposed closer to the rear shaft 14. The backrest (U) has a larger range of pivoting movement since it is disposed farther from the rear shaft 14.

The advantages and characterizing features of the chair of the present invention are as follows:

1. The present invention is more practical to use than the previously-described prior art since the backrest (U) can be positioned at a desired inclined position.
2. Since the present invention has a fewer number of components, the manufacture and assembly thereof is facilitated, thereby resulting in a lower manufacturing cost.
3. The provision of the restoration force adjusting unit 4 permits adjustments in the force for restoring the backrest (U) to the normal upright position.
4. The seat (T) of the chair of the present invention is also retainable in an inclined position.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A chair, comprising:

a movable base;

a variable-length first cylinder mounted uprightly on said movable base;

a support frame having an upright sleeve which is sleeved rotatably on a top end of said first cylinder, an arm plate which extends forwardly from a top end of said sleeve, and parallel front and rear shafts which are mounted transversely on said arm plate, said rear shaft being interposed between said front shaft and said sleeve;

a pivot frame having a rear end and a front end that is mounted pivotally on said rear shaft, said pivot frame further having a seat and a backrest fixed thereon;

an elongated spring plate unit having a rear end portion which is mounted on said front end of said pivot frame and a front end portion which extends underneath and abuts with said front shaft, said spring plate unit providing a restoration force to bias said pivot frame such that the backrest pivots forwardly to a normal upright position; and a variable-length second cylinder connected to a bottom end of said support frame and to said rear end of said pivot frame, said second cylinder being operable so as to vary a length thereof in order to cause pivoting movement of said pivot frame and permit retaining of said seat and said backrest at desired inclined positions.

2. The chair as claimed in claim 1, wherein said first and second cylinders are pneumatic cylinders.

3. The chair as claimed in claim 1, further comprising a restoration force adjusting unit mounted on said support frame and operable so as to apply a variable downward pressure on said spring plate unit to vary the restoration force that is provided by said spring plate unit.

4. The chair as claimed in claim 3, wherein said restoration force adjusting unit comprises:

a bent shaft having two aligned end sections and a generally U-shaped intermediate section which interconnects said aligned end sections, each of said end sections being mounted pivotally on a respective end of said front shaft, junctions of said aligned end sections and said intermediate section resting on top of said spring plate unit; and a rotary knob including a threaded shank which is mounted threadedly on said intermediate section of said bent shaft and which has a distal end that abuts against a bottom face of said arm plate;

whereby, rotation of said rotary knob causes said bent shaft to vary the downward pressure applied on said spring plate unit.

* * * * *

UNITED STATES PATENT AND TRADEMARK OFFICE

CERTIFICATE OF CORRECTION

PATENT NO. : 5,419,615

DATED : May 30, 1995

INVENTOR(S) : Andras Dozsa-Farkas

It is certified that error appears in the above—identified patent and that said Letters Patent is hereby corrected as shown below:

Title page, item [73] delete "Prov. of China"

Signed and Sealed this

Ninth Day of January, 1996

*Attest:*

*Attesting Officer*

BRUCE LEHMAN

*Commissioner of Patents and Trademarks*